US007666267B2

(12) United States Patent
Benedictus et al.

(10) Patent No.: US 7,666,267 B2
(45) Date of Patent: Feb. 23, 2010

(54) AL-ZN-MG-CU ALLOY WITH IMPROVED DAMAGE TOLERANCE-STRENGTH COMBINATION PROPERTIES

(75) Inventors: Rinze Benedictus, Delft (NL); Christian Joachim Keidel, Montabaur (DE); Alfred Ludwig Heinz, Niederahr (DE); Nedia Telioui, Rotterdam (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 386 days.

(21) Appl. No.: 10/821,184

(22) Filed: Apr. 9, 2004

(65) Prior Publication Data

US 2005/0189044 A1 Sep. 1, 2005

Related U.S. Application Data

(60) Provisional application No. 60/469,829, filed on May 13, 2003.

(30) Foreign Application Priority Data

Apr. 10, 2003 (EP) ..... 03076048

(51) Int. Cl.
*C22C 21/10* (2006.01)
*C22F 1/053* (2006.01)

(52) U.S. Cl. ..... 148/417; 148/694; 148/701; 420/532; 420/553

(58) Field of Classification Search ..... 148/417, 148/690, 694, 701; 420/532, 553

See application file for complete search history.

(56) References Cited

U.S. PATENT DOCUMENTS

| | | | |
|---|---|---|---|
| 3,791,880 | A | 2/1974 | Hunsicker et al. |
| 3,794,531 | A | 2/1974 | Markworth et al. |
| 3,857,973 | A | 12/1974 | McKee et al. |
| 3,881,966 | A | 5/1975 | Staley et al. |
| 4,140,549 | A | 2/1979 | Chia et al. |
| 4,305,763 | A | 12/1981 | Quist et al. |
| 4,477,292 | A | 10/1984 | Brown |

(Continued)

FOREIGN PATENT DOCUMENTS

DE 68927149 4/1997

(Continued)

OTHER PUBLICATIONS

Machine translation of excerpts of published PCT patent application No. WO95/26420, published Oct. 1995.

(Continued)

*Primary Examiner*—Roy King
*Assistant Examiner*—Janelle Morillo
(74) *Attorney, Agent, or Firm*—Novak Druce + Quigg LLP

(57) ABSTRACT

An Al—Zn—Mg—Cu alloy with improved damage tolerance-strength combination properties. The present invention relates to an aluminium alloy product comprising or consisting essentially of, in weight %, about 6.5 to 9.5 zinc (Zn), about 1.2 to 2.2% magnesium (Mg), about 1.0 to 1.9% copper (Cu), preferable (0.9Mg−0.6)≦Cu≦(0.9Mg+0.05), about 0 to 0.5% zirconium (Zr), about 0 to 0.7% scandium (Sc), about 0 to 0.4% chromium (Cr), about 0 to 0.3% hafnium (Hf), about 0 to 0.4% titanium (Ti), about 0 to 0.8% manganese (Mn), the balance being aluminium (Al) and other incidental elements. The invention relates also to a method of manufacturing such as alloy.

59 Claims, 2 Drawing Sheets

U.S. PATENT DOCUMENTS

| | | | | |
|---|---|---|---|---|
| 4,589,932 | A | 5/1986 | Park | |
| 4,828,631 | A | 5/1989 | Ponchel et al. | |
| 4,927,470 | A | 5/1990 | Cho | |
| 4,946,517 | A | 8/1990 | Cho | |
| 4,954,188 | A | 9/1990 | Ponchel et al. | |
| 4,976,790 | A | 12/1990 | McAuliffe et al. | |
| 4,988,394 | A | 1/1991 | Cho | |
| 5,108,520 | A | 4/1992 | Liu et al. | |
| 5,186,235 | A | 2/1993 | Ward, Jr. | |
| 5,213,639 | A | 5/1993 | Colvin et al. | |
| 5,221,377 | A | 6/1993 | Hunt, Jr. et al. | |
| 5,312,498 | A | 5/1994 | Anderson | |
| 5,356,495 | A | 10/1994 | Wyatt-Mair et al. | |
| 5,496,423 | A | 3/1996 | Wyatt-Mair et al. | |
| 5,496,426 | A | 3/1996 | Murtha | |
| 5,560,789 | A | 10/1996 | Sainfort et al. | |
| 5,593,516 | A | 1/1997 | Cassada, III | |
| 5,624,632 | A | 4/1997 | Baumann | |
| 5,681,405 | A | 10/1997 | Newton et al. | |
| 5,718,780 | A | 2/1998 | Bryant et al. | |
| 5,833,775 | A | 11/1998 | Newton et al. | |
| 5,858,134 | A | 1/1999 | Bechet et al. | |
| 5,865,911 | A | 2/1999 | Miyasato et al. | |
| 5,865,914 | A | 2/1999 | Karabin et al. | |
| 5,888,320 | A | 3/1999 | Dorward | |
| 5,938,867 | A | 8/1999 | Dorward et al. | |
| 6,027,582 | A | 2/2000 | Shahani et al. | |
| 6,120,623 | A | 9/2000 | Gupta et al. | |
| 6,224,992 | B1 | 5/2001 | Delbeke et al. | |
| 6,315,842 | B1 | 11/2001 | Shahani et al. | |
| 6,337,147 | B1 | 1/2002 | Haszler et al. | |
| 6,543,122 | B1 | 4/2003 | Perkins et al. | |
| 6,562,154 | B1 | 5/2003 | Rioja et al. | |
| 6,569,542 | B2 | 5/2003 | Warner et al. | |
| 6,602,361 | B2 | 8/2003 | Warner et al. | |
| 6,652,678 | B1 | 11/2003 | Marshall et al. | |
| 6,743,308 | B2 | 6/2004 | Tanaka et al. | |
| 6,790,407 | B2 | 9/2004 | Fridlyander et al. | |
| 6,972,110 | B2 | 12/2005 | Chakrabarti et al. | |
| 7,060,139 | B2 | 6/2006 | Senkov et al. | |
| 7,250,223 | B2 | 7/2007 | Miyachi et al. | |
| 2002/0121319 | A1* | 9/2002 | Chakrabarti et al. | 148/694 |
| 2004/0007295 | A1 | 1/2004 | Lorentzen et al. | |
| 2004/0101434 | A1* | 5/2004 | Fridlyander et al. | 420/532 |

FOREIGN PATENT DOCUMENTS

| | | | |
|---|---|---|---|
| DE | 102004010700 | | 10/2004 |
| DE | 10392805 | | 6/2005 |
| EP | 0368005 | | 5/1990 |
| EP | 0377779 | | 7/1990 |
| EP | 0587274 | | 3/1994 |
| EP | 0605947 | | 7/1994 |
| EP | 0799900 | | 10/1997 |
| EP | 0829552 | | 3/1998 |
| EP | 1026270 | | 8/2000 |
| EP | 1114877 | | 7/2001 |
| EP | 1143027 | | 10/2001 |
| EP | 1170394 | | 1/2002 |
| EP | 1231290 | | 8/2002 |
| EP | 1306455 | | 5/2003 |
| GB | 0925956 | | 5/1963 |
| GB | 2114601 | | 8/1983 |
| JP | 61049796 | | 3/1986 |
| JP | 62122744 | | 6/1987 |
| JP | 62122745 | | 6/1987 |
| JP | 63319143 | | 12/1988 |
| JP | 1039340 | | 2/1989 |
| JP | 1208438 | | 8/1989 |
| JP | 2047244 | | 2/1990 |
| JP | 6228691 | | 8/1994 |
| JP | 2002241882 | | 8/2002 |
| RU | 2044098 | C1 | 9/1995 |
| RU | 1 625 043 | A1 | 10/1995 |
| RU | 2165996 | C1 | 4/2001 |
| SU | 664 570 | A | 5/1979 |
| WO | 9526420 | | 10/1995 |
| WO | 9628582 | | 9/1996 |
| WO | 9629440 | | 9/1996 |
| WO | 9722724 | | 6/1997 |
| WO | 9837251 | | 8/1998 |
| WO | 0054967 | | 9/2000 |
| WO | 0210468 | A | 2/2002 |
| WO | 02052053 | | 7/2002 |
| WO | 02075010 | | 9/2002 |
| WO | WO 02/100468 | | 12/2002 |
| WO | 03076677 | | 9/2003 |
| WO | 03085145 | | 10/2003 |
| WO | 04001080 | | 12/2003 |

OTHER PUBLICATIONS

US Published Patent Application No. 2004/0109787A1, (U.S. Appl. No. 10/725,501), Haszler et al., filed Dec. 3, 2003, published Jun. 10, 2004.

US Published Patent Application No. 2002/0150498, (U.S. Appl. No. 09/773,270), Chakrabarti et al., filed Jan. 31, 2001, published Oct. 17, 2002.

US Published Patent Application No. 2002/014288, (U.S. Appl. No. 09/479,924), Warner et al., filed Jan. 10, 2000, published Feb. 7, 2002.

US Published Patent Application No. 2001/0006082, (U.S. Appl. No. 09/734,661), Warner et al., filed Dec. 13, 2000, published Jul. 5, 2001.

US Published Patent Application No. 2002/0014290, (U.S. Appl. No. 09/826,289), Dif et al., filed Apr. 5, 2001, published Feb. 7, 2002.

US Published Patent Application No. 2002/0039664, (U.S. Appl. No. 09/873,031), Magnusen et al., filed, Jun. 1, 2001, published, Apr. 4, 2002.

US Published Appln. No. 2002/043311 A1, (U.S. Appl. No. 09/975,675), Selepack et al., filed Oct. 10, 2001, published Apr. 18, 2002.

US Published Appln. No. 2005/0072497, (U.S. Appl. No. 10/406,610), Eberl et al, filed Apr. 4, 2003, published Apr. 7, 2005.

US Published Appln. No. 2005/006010, (U.S. Appl. No. 10/456,183), Benedictus et al., filed Jun. 9, 2003, published Jan. 13, 2005.

US Published Appln. No. 2005/0189044 A1, (U.S. Appl. No. 10/821,184), Benedictus et al., Filed Apr. 9, 2004, published Sep. 1, 2005.

US Published Appln. No. 2002/0153072 A1, (U.S. Appl. No. 10/003,515), Tanaka et al., filed Nov. 2, 2001, published Oct. 24, 2002.

US Published Appln. No. 2007/0000583 A1, (U.S. Appl. No. 10/334,388), Rioja et al., filed Dec. 31, 2002, published Jan. 4, 2007.

US Published Appln. No. 2002/0162609 A1, (U.S. Appl. No. 10/066,788), Warner, filed Feb. 6, 2002, published Nov. 7, 2002.

US Published Appln. No. 2003/0219353 A1, (U.S. Appl. No. 10/406,609), Warner et al., filed Apr. 4, 2003, published Nov. 27, 2003.

US Published Appln. No. 2004/0211498 A1, (U.S. Appl. No. 10/787,257), Keidel et al., filed Feb. 27, 2004, published Oct. 28, 2004.

US Published Appln. No. 2005/0067066 A1, (U.S. Appl. No. 10/934,783), Tanaka, et al., filed Sep. 7, 2004, published Mar. 31, 2005.

"Heat Treating of Aluminum Alloys," ASM Handbook, vol. 4, pp. 841-856, 1995.

US Published Appln. No. 2005/0034794 A1, (U.S. Appl. No. 10/819,130), Benedictus et al., filed Apr. 7, 2004, published Feb. 17, 2005.

US Published Appln. No. 2006/0032560 A1, (U.S. Appl. No. 10/976,154), Benedictus et al., filed Oct. 29, 2004, published Feb. 16, 2006.

US Published Appln. No. 2006/0174980 A1, (U.S. Appl. No. 11/239,651), Benedictus et al., filed Sep. 30, 2005, published Aug. 10, 2006.
Lakhtin Yu. M. et al., Material Science, Moscow, "Machine Construction," 1980, p. 40.
Translation of Russian Office Action issued in Russian Application No. 2005134849, dated Mar. 28, 2008.
English-language translation of a claim of SU 664 570 A, published May 25, 1979.
English-language translation of the Abstract of SU 1625 043 A1, published Oct. 20, 1995.
English-language translation of Lakhtin, Yu. M. et al., Material Science, Moscow, "Machine Construction," 1980, p. 40.
V.I. Dobatkin, Smelting and Casting of Aluminum Alloys, Moscow, "Metallurgy," 1970, p. 27.
The Russian State Standard GOST 4784-97. Aluminum and wrought aluminum alloys. Grades, Minsk, Publisher or Standards, 1999, p. 7, 8, table 6.
Russian Office action dated Jul. 1, 2008 from Russian patent application No. 2005134849/02(038965).
The Russian State Standard GOST 4784-97. Aluminum and wrought aluminum alloys. Grades, Minsk, Publisher or Standards, 1999, p. 7, 8, table 6.
ASM Specialty Handbook Aluminum and Aluminum Alloys, J.R. Davis, ASM International Handbook Committee, pp. 290-295 and 319-320 copyright 1993.
Aluminum Properties and Physical Metallurgy, John E. Hatch, American Society for Metals, pp. 150-157 copyright 1984.

* cited by examiner

AL-ZN-MG-CU ALLOY WITH IMPROVED DAMAGE TOLERANCE-STRENGTH COMBINATION PROPERTIES

CROSS-REFERENCE TO RELATED APPLICATIONS

This claims priority from U.S. provisional patent application Ser. No. 60/469,829 filed May 13, 2003 and European patent application No. 03076048.2 filed Apr. 10, 2003, both incorporated herein by reference in their entirety.

FIELD OF THE INVENTION

The invention relates to a wrought Al—Zn—Mg—Cu aluminium type (or 7000- or 7xxx-series aluminium alloys as designated by the Aluminum Association). More specifically, the present invention is related to an age-hardenable, high strength, high fracture toughness and highly corrosion resistant aluminium alloy and products made of that alloy. Products made from this alloy are very suitable for aerospace applications, but not limited to that. The alloy can be processed to various product forms, e.g. sheet, thin plate, thick plate, extruded or forged products.

In every product form, made from this alloy, property combinations can be achieved that are outperforming products made from nowadays known alloys. Because of the present invention, the uni-alloy concept can now be used also for aerospace applications. This will lead to significant cost reduction in the aerospace industry. Recycleability of the aluminium scrap produced during the production of the structural part or at the end of the life-cycle of the structural part will become significant easier because of the uni-alloy concept.

BACKGROUND OF THE INVENTION

Different types of aluminium alloys have been used in the past for forming a variety of products for structural applications in the aerospace industry. Designers and manufacturers in the aerospace industry are constantly trying to improve fuel efficiency, product performance and constantly trying to reduce the manufacturing and service costs. The preferred method for achieving the improvements, together with the cost reduction, is the uni-alloy concept, i.e. one aluminium alloy that is capable of having improved property balance in the relevant product forms.

The alloy members and temper designations used herein are in accordance with the well-known aluminium alloy product standards of the Aluminum Association. All percentages are in weight percents, unless otherwise indicated.

State of the art at this moment is high damage tolerant AA2x24 (i.e. AA2524) or AA6x13 or AA7x75 for fuselage sheet, AA2324 or AA7x75 for lower wing, AA7055 or AA7449 for upper wing and AA7050 or AA7010 or AA7040 for wing spars and ribs or other sections machined from thick plate. The main reason for using different alloys for each different application is the difference in the property balance for optimum performance of the whole structural part.

For fuselage skin, damage tolerant properties under tensile loading are considered to be very important, that is a combination of fatigue crack growth rate ("FCGR"), plane stress fracture toughness and corrosion. Based on these property requirements, high damage tolerant AA2x24-T351 (see e.g. U.S. Pat. No. 5,213,639 or EP-1026270-A1) or Cu containing AA6xxx-T6 (see e.g. U.S. Pat. No. 4,589,932, U.S. Pat. No. 5,888,320, US-2002/0039664-A1 or EP-1143027-A1) would be the preferred choice of civilian aircraft manufacturers.

For lower wing skin a similar property balance is desired, but some toughness is allowably sacrificed for higher tensile strength. For this reason AA2x24 in the T39 or a T8x temper are considered to be logical choices (see e.g. U.S. Pat. No. 5,865,914, U.S. Pat. No. 5,593,516 or EP-1114877-A1), although AA7x75 in the same temper is sometimes also applied.

For upper wing, where compressive loading is more important than the tensile loading, the compressive strength, fatigue (SN-fatigue or life-time) and fracture toughness are the most critical properties. Currently, the preferred choice would be AA7150, AA7055, AA7449 or AA7x75 (see e.g. U.S. Pat. Nos. 5,221,377, 5,865,911, 5,560,789 or U.S. Pat. No. 5,312,498). These alloys have high compressive yield strength with at the moment acceptable corrosion resistance and fracture toughness, although aircraft designers would welcome improvements on these property combinations.

For thick sections having a thickness of more than 3 inch or parts machined from such thick sections, a uniform and reliable property balance through thickness is important. Currently, AA7050 or AA7010 or AA7040 (see U.S. Pat. No. 6,027,582) or C80A (see US-2002/0150498-A1) are used for these types of applications. Reduced quench sensitivity, that is deterioration of properties through thickness with lower quenching speed or thicker products, is a major wish from the aircraft manufactures. Especially the properties in the ST-direction are a major concern of the designers and manufactures of structural parts.

A better performance of the aircraft, i.e. reduced manufacturing cost and reduced operation cost, can be achieved by improving the property balance of the aluminium alloys used in the structural part and preferably using only one type of alloy to reduce the cost of the alloy and to reduce the cost in the recycling of aluminium scrap and waste.

Accordingly, it is believed that there is a demand for an aluminium alloy capable of achieving the improved proper property balance in every relevant product form.

SUMMARY OF INVENTION

The present invention is directed to an AA7xxx-series aluminium alloy having the capability of achieving a property balance in any relevant product that is better than property balance of the variety of commercial aluminium alloys (AA2xxx, AA6xxx, AA7xxx) nowadays used for those products.

A preferred composition of the alloy of the present invention comprises or consists essentially of, in weight %, about 6.5 to 9.5 zinc (Zn), about 1.2 to 2.2% magnesium (Mg), about 1.0 to 1.9% copper (Cu), about 0 to 0.5% zirconium (Zr), about 0 to 0.7% scandium (Sc), about 0 to 0.4% chromium (Cr), about 0 to 0.3% hafnium (Hf), about 0 to 0.4% titanium (Ti), about 0 to 0.8% manganese (Mn), the balance being aluminium (Al) and other incidental elements. Preferably $(0.9Mg-0.6) \leqq Cu \leqq (0.9Mg+0.05)$.

A more preferred alloy composition according to the invention consists essentially of, in weight %, about 6.5 to 7.9% Zn, about 1.4 to 2.10% Mg, about 1.2 to 1.80% Cu, and preferably wherein $(0.9Mg-0.5) \leqq Cu \leqq 0.9Mg$, about 0 to 0.5% Zr, about 0 to 0.7% Sc, about 0 to 0.4% Cr, about 0 to 0.3% Hf, about 0 to 0.4% Ti, about 0 to 0.8% Mn, the balance being Al and other incidental elements.

A more preferred alloy composition according to the invention consists essentially of, in weight %, about 6.5 to 7.9% Zn, about 1.4 to 1.95% Mg, about 1.2 to 1.75% Cu, and preferably wherein (0.9Mg−0.5)≦Cu≦(0.9Mg−0.1), about 0 to 0.5% Zr, about 0 to 0.7% Sc, about 0 to 0.4% Cr, about 0 to 0.3% Hf, about 0 to 0.4% Ti, about 0 to 0.8% Mn, the balance being aluminium and other incidental elements.

In a more preferred embodiment, the lower limit for the Zn-content is 6.7%, and more preferably 6.9%.

In a more preferred embodiment, the lower limit for the Mg-content of 1.90%, and more preferably 1.92%. This lower-limit for the Mg-content is in particular preferred when the alloy product is being used for sheet product, e.g. fuselage sheet, and when used for sections made from thick plate.

The above mentioned aluminium alloys may contain impurities or incidental or intentionally additions, such as for example at most 0.3% Fe, preferably at most 0.14% Fe, at most 0.2% silicon (Si), and preferably at most 0.12% Si, at most 1% silver (Ag), at most 1% germanium (Ge), at most 0.4% vanadium (V). The other additions are generally governed by the 0.05-0.15 weight % ranges as defined in the Aluminium Association, thus each unavoidable impurity in a range of <0.05%, and the total of impurities <0.15%.

The iron and silicon contents should be kept significantly low, for example not exceeding about 0.08% Fe and about 0.07% Si or less. In any event, it is conceivable that still slightly higher levels of both impurities, at most about 0.14% Fe and at most about 0.12% Si may be tolerated, though on a less preferred basis herein. In particular for the mould plates or tooling plates embodiments hereof, even higher levels of at most 0.3% Fe and at most 0.2% Si or less, are tolerable.

The dispersoid forming elements like for example Zr, Sc, Hf, Cr and Mn are added to control the grain structure and the quench sensitivity. The optimum levels of dispersoid formers do depend on the processing, but when one single chemistry of main elements (Zn, Cu and Mg) is chosen within the preferred window and that chemistry will be used for all relevant product forms, then Zr levels are preferably less than 0.11%.

A preferred maximum for the Zr level is a maximum of 0.15%. A suitable range of the Zr level is a range of 0.04 to 0.15%. A more preferred upper-limit for the Zr addition is 0.13%, and even more preferably not more than 0.11%.

The addition of Sc is preferably not more than 0.3%, and preferably not more than 0.18%. When combined with Sc, the sum of Sc+Zr should be less then 0.3%, preferably less than 0.2%, and more preferably at a maximum of 0.17%, in particular where the ratio of Zr and Sc is between 0.7 and 1.4.

Another dispersoid former that can be added, alone or with other dispersoid formers is Cr. Cr levels should be preferable below 0.3%, and more preferably at a maximum of 0.20%, and even more preferably 0.15%. When combined with Zr, the sum of Zr+Cr should not be above 0.20%, and preferably not more than 0.17%.

The preferred sum of Sc+Zr+Cr should not be above 0.4%, and more preferably not more than 0.27%.

Also Mn can be added alone or in combination with one of the other dispersoid formers. A preferred maximum for the Mn addition is 0.4%. A suitable range for the Mn addition is in the range of 0.05 to 0.40%, and preferably in the range of 0.05 to 0.30%, and even more preferably 0.12 to 0.30%. A preferred lower limit for the Mn addition is 0.12%, and more preferably 0.15%. When combined with Zr, the sum of Mn+Zr should be less then 0.4%, preferably less than 0.32%, and a suitable minimum is 0.14%.

In another embodiment of the aluminium alloy product according to the invention the alloy is free of Mn, in practical terms this would mean that the Mn-content is <0.02%, and preferably <0.01%, and more preferably the alloy is essentially free or substantially free from Mn. With "substantially free" and "essentially free" we mean that no purposeful addition of this alloying element was made to the composition, but that due to impurities and/or leaching from contact with manufacturing equipment, trace quantities of this element may, nevertheless, find their way into the final alloy product.

In a particular embodiment of the wrought alloy product according to this invention, the alloy consists essentially of, in weight percent:

| | |
|---|---|
| Zn | 7.2 to 7.7, and typically about 7.43 |
| Mg | 1.79 to 1.92, and typically about 1.83 |
| Cu | 1.43 to 1.52, and typically about 1.48 |
| Zr or Cr | 0.04 to 0.15, preferably 0.06 to 0.10, and typically 0.08 |
| Mn | optionally in a range of 0.05 to 0.19, and preferably 0.09 to 0.19, or in an alternative embodiment < 0.02, preferably < 0.01 |
| Si | <0.07, and typically about 0.04 |
| Fe | <0.08, and typically about 0.05 |
| Ti | <0.05, and typically about 0.01 |

balance aluminium and inevitable impurities each <0.05, total <0.15.

In another particular embodiment of the wrought alloy product according to this invention, the alloy consists essentially of, in weight percent:

| | |
|---|---|
| Zn | 7.2 to 7.7, and typically about 7.43 |
| Mg | 1.90 to 1.97, preferably 1.92 to 1.97, and typically about 1.94 |
| Cu | 1.43 to 1.52, and typically about 1.48 |
| Zr or Cr | 0.04 to 0.15, preferably 0.06 to 0.10, and typically 0.08 |
| Mn | optionally in a range of 0.05 to 0.19, and preferably of 0.09 to 0.19, or in an alternative embodiment < 0.02, preferably <0.01 |
| Si | <0.07, and typically about 0.05 |
| Fe | <0.08, and typically about 0.06 |
| Ti | <0.05, and typically about 0.01 |

balance aluminium and inevitable impurities each <0.05, total <0.15.

The alloy product according to the invention can be prepared by conventional melting and may be (direct chill, D.C.) cast into ingot form. Grain refiners such as titanium boride or titanium carbide may also be used. After scalping and possible homogenisation, the ingots are further processed by, for example extrusion or forging or hot rolling in one or more stages. This processing may be interrupted for an inter-anneal. Further processing may be cold working, which may be cold rolling or stretching. The product is solution heat treated and quenched by immersion in or spraying with cold water or fast cooling to a temperature lower than 95° C. The product can be further processed, for example by rolling or stretching, for example at most 8%, or may be stress relieved by stretching or compression at most about 8%, for example, from about 1 to 3%, and/or aged to a final or intermediate temper. The product may be shaped or machined to the final or intermediate structure, before or after the final ageing or even before solution heat treatment.

DETAILED DESCRIPTION OF THE INVENTION

The design of commercial aircraft requires different sets of properties for different types of structural parts. An alloy when processed to various product forms (i.e., sheet, plate, thick plate, forging or extruded profile etc.) and to be used in a wide variety of structural parts with different loading sequences in service life and consequently meeting different material requirements for all those product forms, must be unprecedentedly versatile.

The important material properties for a fuselage sheet product are the damage tolerant properties under tensile loads (i.e. FCGR, fracture toughness and corrosion resistance).

The important material properties for a lower wing skin in a high capacity and commercial jet aircraft are similar to those for a fuselage sheet product, but typically a higher tensile strength is wished by the aircraft manufactures. Also fatigue life becomes a major material property.

Because the airplane flies at high altitude where it is cold, fracture toughness at minus 65° F. is a concern in new designs of commercial aircrafts. Additional desirable features include age formability whereby the material can be shaped during artificial aging, together with good corrosion performance in the areas of stress corrosion cracking resistance and exfoliation corrosion resistance.

The important material properties for an upper wing skin product are the properties under compressive loads, i.e. compressive yield strength, fatigue life and corrosion resistance.

The important material properties for machined parts from thick plate depend on the machined part. But, in general, the gradient in material properties through thickness must be very small and the material properties like strength, fracture toughness, fatigue and corrosion resistance must be a high level.

The present invention is directed at an alloy composition when processed to a variety of products, such as, but not limited to, sheet, plate, thick plate etc, will meet or exceed the desired material properties. The property balance of the product will out-perform the property balance of the product made from nowadays commercially used alloys.

It has been found very surprisingly a chemistry window within the AA7000 window, unexplored before, that does fulfil this unique capability.

The present invention resulted from an investigation on the effect of Cu, Mg and Zn levels, combined with various levels and types of dispersoid former (e.g. Zr, Cr, Sc, Mn) on the phases formed during processing. Some of these alloys were processed to sheet and plate and tested on tensile, Kahn-tear toughness and corrosion resistance. Interpretations of these results lead to the surprising insight that an aluminium alloy with a chemical composition within a certain window, will exhibit excellent properties as well as for sheet as for plate as for thick plate as for extrusions as for forgings.

In another aspect of the invention there is provided a method of manufacturing the aluminium alloy product according to the invention. The method of manufacturing a high-strength, high-toughness AA7000-series alloy product having a good corrosion resistance, comprising the processing steps of:

a.) casting an ingot having a composition as set out in the present description;

b.) homogenising and/or pre-heating the ingot after casting;

c.) hot working the ingot into a pre-worked product by one or more methods selected from the group consisting of: rolling, extruding and forging;

d.) optional reheating the pre-worked product and either, e.) hot working and/or cold working to a desired workpiece form;

f.) solution heat treating (SHT) the formed workpiece at a temperature and time sufficient to place into solid solution essentially all soluble constituents in the alloy;

g.) quenching the solution heat treated workpiece by one of spray quenching or immersion quenching in water or other quenching media;

h.) optionally stretching or compressing of the quenched work piece or otherwise cold worked to relieve stresses, for example levelling of sheet products;

i.) artificially ageing the quenched and optionally stretched or compressed workpiece to achieve a desired temper, for example, the tempers selected from the group comprising: T6, T74, T76, T751, T7451, T7651, T77 and T79.

The alloy products of the present invention are conventionally prepared by melting and may be direct chill (D.C.) cast into ingots or other suitable casting techniques. Homogenisation treatment is typically carried out in one or multi steps, each step having a temperature preferably in the range of 460 to 490° C. The pre-heat temperature involves heating the rolling ingot to the hot-mill entry temperature, which is typically in a temperature range of 400 to 460° C. Hot working the alloy product can be done by one or more methods selected from the group consisting of rolling, extruding and forging. For the present alloy hot rolling is being preferred. Solution heat treatment is typically carried out in the same temperature range as used for homogenisation, although the soaking times can be chosen somewhat shorter.

In an embodiment of the method according to the invention the artificial ageing step i.) comprises a first ageing step at a temperature in a range of 105° C. to 135° C. preferably for 2 to 20 hours, and a second ageing step at a temperature in a range of 135° C. to 210° C. preferably for 4 to 20 hours. In a further embodiment a third ageing step may be applied at a temperature in a range of 105° C. to 135° C. and preferably for 20 to 30 hours.

A surprisingly excellent property balance is being obtained in whatever thickness is produced. In the sheet thickness range of at most 1.5 inch the properties will be excellent for fuselage sheet, and preferably the thickness is at most 1 inch. In the thin plate thickness range of 0.7 to 3 inch the properties will be excellent for wing plate, e.g. lower wing plate. The thin plate thickness range can be used also for stringers or to form an integral wing panel and stringer for use in an aircraft wing structure. More peak-aged material will give an excellent upper wing plate, whereas slightly more over-ageing will give excellent properties for lower wing plate. When processed to thicker gauges of more than 2.5 inch up to about 11 inch or more excellent properties will be obtained for integral parts machined from plates, or to form an integral spar for use in an aircraft wing structure, or in the form of a rib for use in an aircraft wing structure. The thicker gauge products can be used also as tooling plate or mould plate, e.g. moulds for manufacturing formed plastic products, for example via die-casting or injection moulding. When thickness ranges are given hereinabove, it will be immediately apparent to the skilled person that this is the thickness of the thickest cross sectional point in the alloy product made from such a sheet, thin plate or thick plate. The alloy products according to the invention can also be provided in the form of a stepped extrusion or extruded spar for use in an aircraft structure, or in the form of a forged spar for use in an aircraft wing structure. Surprisingly, all these products with excellent properties can be obtained from one alloy with one single chemistry.

In the embodiment whereby structural components, e.g. ribs, are made from the alloy product according to the invention having a thickness of 2.5 inch or more, the component increased elongation compared to its AA7050 aluminium alloy counterpart. In particular the elongation (or A50) in the ST testing direction is 5% or more, and in the best results 5.5% or more.

Furthermore, in the embodiment whereby structural components are made from the alloy product according to the invention having a thickness of 2.5 inch or more, the component has a fracture toughness Kapp in the L-T testing direction at ambient room temperature and when measured at S/4 according to ASTM E561 using 16-inch centre cracked panels (M(T) or CC(T)) showing an at least 20% improvement compared to its AA7050 aluminium alloy counterpart, and in the best examples an improvement of 25% or more is found.

In the embodiment where the alloy product has been extruded, preferably the alloy products have been extruded into profiles having at their thickest cross sectional point a thickness in the range of up to 10 mm, and preferably in the range of 1 to 7 mm. However, in extruded form the alloy product can also replace thick plate material which is conventionally machined via high-speed machining or milling techniques into a shaped structural component. In this embodiment the extruded alloy product has preferably at its thickest cross sectional point a thickness in a range of 2 to 6 inches.

BRIEF DESCRIPTION OF THE DRAWINGS

FIG. 1 shows schematically the ranges for the Cu and Mg for the alloy according to the present invention in their preferred embodiments as set out in dependent claims 2 to 4. Also shown are two narrower more preferred ranges.

The ranges can also be identified by using the corner-points A, B, C, D, E, and F of a hexagon box. Preferred ranges are identified by A' to F', and more preferred ranges by A" to F". The coordinates are listed in Table 1. In FIG. 1 also the alloy composition according to this invention as mentioned in the examples hereinafter are illustrated as individual points.

TABLE 1

Figure 1:
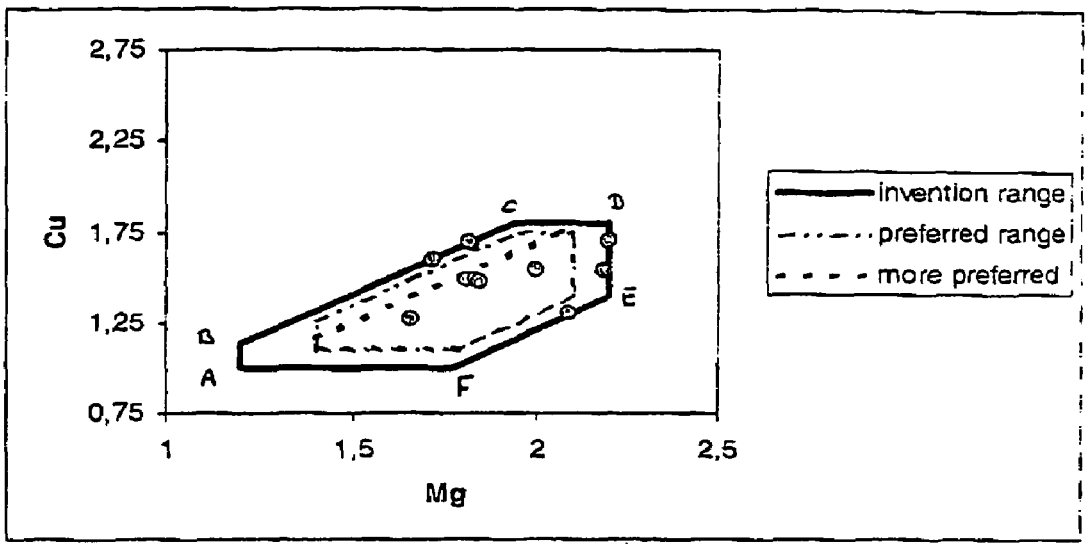
FIG. 1 is an Mg—Cu diagram setting out the Cu—Mg range for the alloy according to this invention, together with narrower preferred ranges.

Coordinates (in wt. %) for the corner-points of the Cu—Mg ranges for the preferred ranges of the alloy product according to the invention.

| Corner point | (Mg, Cu) wide range | Corner point | (Mg, Cu) preferred range | Corner point | (Mg, Cu) more preferred range |
|---|---|---|---|---|---|
| A | 1.20, 1.00 | A' | 1.40, 1.10 | A" | 1.40, 1.10 |
| B | 1.20, 1.13 | B' | 1.40, 1.26 | B" | 1.40, 1.16 |
| C | 2.05, 1.90 | C' | 2.05, 1.80 | C" | 2.05, 1.75 |
| D | 2.20, 1.90 | D' | 2.10, 1.80 | D" | 2.10, 1.75 |
| E | 2.20, 1.40 | E' | 2.10, 1.40 | E" | 2.10, 1.40 |
| F | 1.77, 1.00 | F' | 1.78, 1.10 | F" | 1.87, 1.10 |

EXAMPLES

Example 1

On a laboratory scale alloys were cast to prove the principle of the current invention and processed to 4.0 mm sheet or 30 mm plate. The alloy compositions are listed in Table 2, for all ingots Fe <0.06, Si <0.04, Ti 0.01, balance aluminium. Rolling blocks of approximately 80 by 80 by 100 mm (height×width×length) were sawn from round lab cast ingots of about 12 kg. The ingots were homogenised at 460±5° C. for about 12 hrs and consequently at 475±5° C. for about 24 hrs and consequently slowly air cooled to mimic an industrial homogenisation process. The rolling ingots were pre-heated for about 6 hrs at 410±5° C. At an intermediate thickness range of about 40 to 50 mm the blocks were re-heated at 410±5° C. Some blocks were hot rolled to the final gauge of 30 mm, others were hot rolled to a final gauge of 4.0 mm. During the whole hot-rolling process, care was taken to mimic an industrial scale hot rolling. The hot-rolled products were solution heat treated and quenched. Most were quenched in water, but some were also quenched in oil to mimic the mid and quarter-thickness quenching-rate of a 6-inch thick plate. The products were cold stretched by about 1.5% to relieve the residual stresses. The ageing behaviour of the alloys was investigated. The final products were over-aged to a near peak aged strength (e.g. T76 or T77 temper).

Tensile properties have been tested according EN10.002. The tensile specimens from the 4 mm thick sheet were flat EURO-NORM specimen with 4 mm thickness. The tensile specimens from the 30 mm plate were round tensile specimens taken from mid-thickness. The tensile test results in Table 1 are from the L-direction. The Kahn-tear toughness is tested according to ASTM B871-96. The test direction of the results on Table 2 is the T-L direction. The so-called notch-toughness can be obtained by dividing the tear-strength, obtained by the Kahn-tear test, by the tensile yield strength ("TS/Rp"). This typical result from the Kahn-tear test is known in the art to be a good indicator for true fracture toughness. The unit propagation energy ("UPE"), also obtained by the Kahn-tear test, is the energy needed for crack growth. It is believed that the higher the UPE, the more difficult to grow the crack, which is a desired feature of the material.

To qualify for a good corrosion performance, the exfoliation corrosion resistance ("EXCO") when measured according to ASTM G34-97 must be at least "EA" or better. The inter-granular corrosion ("IGC") when measured according MIL-H-6088 is preferable absent. Some pitting is acceptable, but preferably should be absent also.

In order to have a promising candidate alloy suitable for a variety of products, it had to fulfil the following requirements on lab-scale: A tensile yield strength of at least 510 MPa, an ultimate strength of at least 560 MPa, a notch toughness of at least 1.5 and a UPE of at least 200 kJ/m$^2$. The results for the various alloys as function of some processing are listed in Table 2 also.

In order to meet all those desired material properties, the chemistry of the alloy has to be carefully balanced. According to the present results, too high values for Cu, Mg and Zn contents were found to be detrimental to toughness and corrosion resistance. Whereas too low values were found to be detrimental for high strength levels.

TABLE 2

| Specimen No. | Invention Alloy (Y/N) | Thickness (mm) | Temper | Mg (wt %) | Cu (wt %) | Zn (wt %) | Zr (wt %) | Others (wt %) |
|---|---|---|---|---|---|---|---|---|
| 1 | yes | 30 | T77 | 1.84 | 1.47 | 7.4 | 0.10 | — |
| 2 | yes | 30 | T76 | 1.66 | 1.27 | 8.1 | 0.09 | — |
| 3 | yes | 4 | T76 | 2.00 | 1.54 | 6.8 | 0.11 | — |
| 4 | no | 4 | T76 | 2.00 | 1.52 | 5.6 | 0.01 | 0.16 Cr |
| 5 | no | 4 | T76 | 2.00 | 1.53 | 5.6 | 0.06 | 0.08 Cr |
| 6 | yes | 4 | T76 | 1.82 | 1.68 | 7.4 | 0.10 | — |
| 7 | yes | 30 | T76 | 2.09 | 1.30 | 8.2 | 0.09 | — |
| 8 | yes | 4 | T77 | 2.20 | 1.70 | 8.7 | 0.11 | — |
| 9 | yes | 4 | T77 | 1.81 | 1.69 | 8.7 | 0.10 | — |
| 10 | no | 4 | T76 | 2.10 | 1.54 | 5.6 | 0.07 | — |
| 11 | no | 4 | T76 | 2.20 | 1.90 | 6.7 | 0.10 | — |
| 12 | no | 4 | T76 | 1.98 | 1.90 | 6.8 | 0.09 | — |
| 13 | no | 4 | T77 | 2.10 | 2.10 | 8.6 | 0.10 | — |
| 14 | no | 4 | T77 | 2.50 | 1.70 | 8.7 | 0.10 | — |
| 15 | no | 4 | T77 | 1.70 | 2.10 | 8.6 | 0.12 | — |
| 16 | no | 4 | T77 | 1.70 | 2.40 | 8.6 | 0.11 | — |
| 17 | no | 4 | T76 | 2.40 | 1.54 | 5.6 | 0.01 | — |
| 18 | no | 4 | T76 | 2.30 | 1.54 | 5.6 | 0.07 | — |
| 19 | no | 4 | T76 | 2.30 | 1.52 | 5.5 | 0.14 | — |
| 20 | yes | 4 | T76 | 2.19 | 1.54 | 6.7 | 0.11 | 0.16 Mn |
| 21 | no | 4 | T76 | 2.12 | 1.51 | 5.6 | 0.12 | — |

| Specimen No. | Invention Alloy (Y/N) | Rp (MPa) | Rm (MPa) | UPE (kJ/m$^2$) | Ts/Rp |
|---|---|---|---|---|---|
| 1 | yes | 587 | 627 | 312 | 1.53 |
| 2 | yes | 530 | 556 | 259 | 1.76 |
| 3 | yes | 517 | 563 | 297 | 1.62 |
| 4 | no | 473 | 528 | 232 | 1.45 |
| 5 | no | 464 | 529 | 212 | 1.59 |
| 6 | yes | 594 | 617 | 224 | 1.44 |
| 7 | yes | 562 | 590 | 304 | 1.64 |
| 8 | yes | 614 | 626 | 115 | 1.38 |
| 9 | yes | 574 | 594 | 200 | 1.47 |
| 10 | no | 490 | 535 | 245 | 1.53 |
| 11 | no | 563 | 608 | — | 1.07 |
| 12 | no | 559 | 592 | — | 1.32 |
| 13 | no | 623 | 639 | 159 | 1.31 |
| 14 | no | 627 | 643 | 117 | 1.33 |
| 15 | no | 584 | 605 | 139 | 1.44 |
| 16 | no | 598 | 619 | 151 | 1.42 |
| 17 | no | 476 | 530 | 64 | 1.42 |
| 18 | no | 488 | 542 | 52 | 1.54 |
| 19 | no | 496 | 543 | 155 | 1.66 |
| 20 | yes | 521 | 571 | 241 | 1.65 |
| 21 | no | 471 | 516 | 178 | 1.42 |

But, very surprisingly, a higher Zn-level is increasing the toughness and crack growth resistance. Therefore, it is desirable to use higher Zn level and combine these with lower Mg and Cu levels. It has been found that the Zn-content should not be below 6.5%, and preferably not below 6.7%, and more preferably not below 6.9%.

Mg is required to have acceptable strength levels. It has been found that a ratio of Mg/Zn of about 0.27 or lower seems to give the best strength-toughness combination. However, Mg levels should not exceed 2.2%, and preferably not exceed 2.1%, and even more preferably not exceed 1.97%, with a more preferred upper level of 1.95%. This upper-limit is lower than in the conventional AA-windows or ranges of presently used commercial aerospace alloys like AA7050, AA7010 and AA7075.

In order to have a desirably very high crack growth resistance (or UPE) Mg levels must be carefully balanced and should preferably be in the same order or slightly more than the Cu levels, and preferably $(0.9\times Mg-0.6)\leqq Cu\leqq(0.9\times Mg+0.05)$. The Cu-content should not be too high. It has been found that the Cu-content should not be higher than 1.9%, and preferably should not exceed 1.80%, and more preferably not exceed 1.75%.

The dispersoid formers used in AA7xxx-series alloys are typically Cr, as in e.g. AA7x75, or Zr, as in e.g. AA7x50 and AA7x10. Conventionally, Mn is believed to be detrimental for toughness, but much to our surprise, a combination of Mn and Zr shows still a very good strength-toughness balance.

Example 2

A batch of full-size rolling ingots with a thickness of 440 mm thick on an industrial scale were produced by a DC-casting and having the chemical composition (in wt. %): 7.43% Zn, 1.83% Mg, 1.48% Cu, 0.08% Zr, 0.02% Si and 0.04% Fe, balance aluminium and unavoidable impurities. One of these ingots was scalped, homogenised at 12 hrs/470° C.+24 hrs/475° C.+air cooled to ambient temperature. This ingot was pre-heated at 8 hrs/410° C. and then hot rolled to about 65 mm. The rolling block was then turned 90 degrees and further hot rolled to about 10 mm. Finally the rolling block was cold rolled to a gauge of 5.0 mm. The obtained sheet was solution heat treated at 475° C. for about 40 minutes, followed by water-spray quenching. The resultant sheets were stress relieved by a cold stretching operation of about 1.8%. Two ageing variants have been produced, variant A: for 5 hrs/120° C.+9 hrs/155° C., and variant B: for 5 hrs/120° C.+9 hrs/165° C.

The tensile results have been measured according to EN 10.002. The compression yield strength ("CYS") has been measured according to ASTM E9-89a. The shear strength has been measured according to ASTM B831-93. The fracture toughness, Kapp, has been measured according to ASTM E561-98 on 16-inch wide centre cracked panels [M(T) or CC(T)]. The Kapp has been measured at ambient room temperature (RT) and at −65° F. As reference material a high damage tolerant ("HDT") AA2x24-T351 has been tested as well. The results are listed in Table 3.

TABLE 3

| | Ageing | L-TYS (MPa) | LT-TYS (MPa) | L-UTS (MPa) | LT-UTS (MPa) | L-T CYS (MPa) | T-L CYS (MPa) |
|---|---|---|---|---|---|---|---|
| INV | Variant A | 544 | 534 | 562 | 559 | 554 | 553 |
| INV | Variant A | 489 | 472 | 526 | 512 | 492 | 500 |
| HDT-2 × 24 | T351 | 360 | 332 | 471 | 452 | 329 | 339 |

| | Ageing | L-T Shear (MPa) | T-L Shear (MPa) | RT L-T Kapp MPa · m | RT T-L Kapp MPa · $m^{0.5}$ | −65° F. L-T Kapp MPa · $m^{0.5}$ | −65° F. L-T Kapp MPa · $m^{0.5}$ |
|---|---|---|---|---|---|---|---|
| INV | Variant A | 372 | 373 | 103 | 100 | — | — |
| INV | Variant B | 340 | 338 | 132 | 127 | 102 | 103 |
| HDT-2 × 24 | T351 | 328 | 312 | — | 101 | — | 103 |

The exfoliation corrosion resistance has been measured according ASTM G34-97. Both variant A and B showed EA rating.

The inter-granular corrosion measured according to MIL-H-6088 for variant A was about 70 μm and for variant B about 45 μm. Both are significantly lower than the typical 200 μm as measured for the reference AA2x24-T351.

From Table 3 it can be seen that there is a significant improvement with the alloy according to the invention. A significant increase in strength at comparable or even higher fracture toughness levels. Also the alloy according to the invention at a low temperature of minus 65° F., outperforms the nowadays standard high damage tolerant fuselage alloy AA2x24-T351. Note that also the corrosion resistance of the inventive alloy is significant better than the AA2x24-T351.

The fatigue crack growth rate ("FCGR") has been measured according to ASTM E647-99 on 4-inch wide compact tension panels [C(T)] with an R-ratio of 0.1. In Table 3 the da/dn per cycle at a stress range of $\Delta K=27.5$ ksi.$in^{0.5}$ (=about 30 MPa.$m^{0.5}$) of the inventive alloy has been compared with the reference high damage tolerant AA2x24-T351.

It can be clearly seen from the results in Table 4 that the crack growth of the inventive alloy is better than that of the high damage tolerant AA2x24-T351.

TABLE 4

| Crack growth per cycle at a stress range of deltaK = 27.5 ksi $in^{0.5}$ | | | |
|---|---|---|---|
| INV | Variant A | L–T | 96% |
| INV | Variant A | T–L | 84% |

TABLE 4-continued

| Crack growth per cycle at a stress range of deltaK = 27.5 ksi $in^{0.5}$ | | | |
|---|---|---|---|
| INV | Variant B | L–T | 73% |
| INV | Variant B | T–L | 74% |
| HDT-2 × 24 | T351 | L–T | 100% |

Example 3

Another full-scale ingot taken from the batch DC-cast from Example 2 was produced into a plate of 6-inch thickness. Also this ingot was scalped, homogenised at 12 hrs/470° C.+24 hrs/475° C.+air cooled to ambient temperature. The ingot was pre-heated at 8 hrs/410° C. and then hot rolled to about 152 mm. The obtained hot-rolled plate was solution heat treated at 475° C. for about 7 hours followed by water-spray quenching. The plates were stress relieved by a cold stretching operation of about 2.0%. Several different two-step ageing processes have been applied.

The tensile results have been measured according to EN 10.002. The specimens were taken from the T/4-position. The plane strain fracture toughness, Kq, has been measured according to ASTM E399-90. If the validity requirements as given in ASTM E399-90 are met, these Kq values are a real material property and called $K_{1c}$. The $K_{1c}$ has been measured at ambient room temperature ("RT"). The exfoliation corrosion resistance has been measured according to ASTM G34-97. The results are listed in Table 5. All ageing variants as shown in Table 5 showed "EA" rating.

Figure 2:
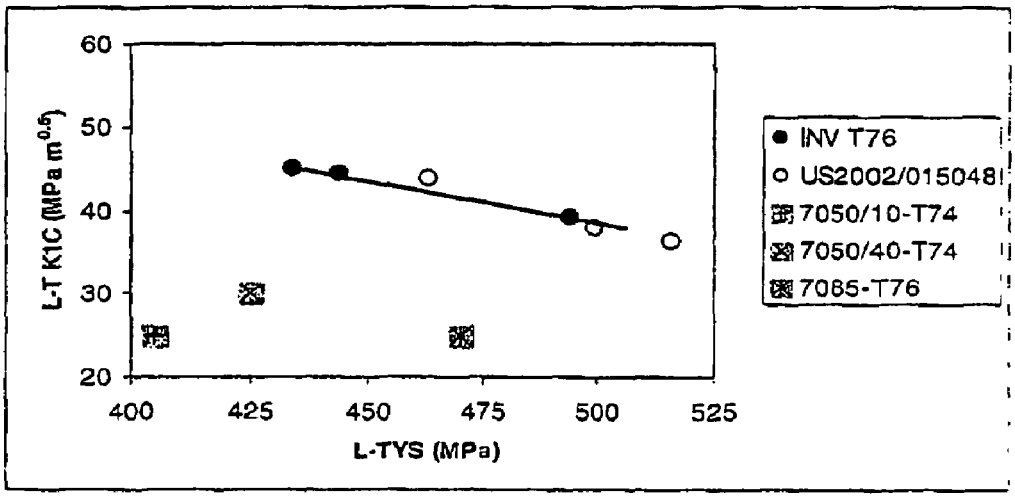
FIG. 2 is a diagram comparing the fracture toughness vs. the tensile yield strength for the alloy product according to the invention against several references.

In FIG. 2 a comparison is given versus results presented in U.S.-2002/0150498-A1, Table 2, incorporated herein by reference. In this U.S.patent application an example (example 1) is given of a similar product, but with a different chemistry that is stated to be optimised for quench sensitivity. In our inventive alloy we have obtained a similar tensile versus toughness balance as in this US patent application. However, our inventive alloys shows at least superior EXCO resistance.

Furthermore, also the elongation of our inventive alloy is superior to that disclosed in U.S. 2002/0150498-A1, Table 2. The overall property balance of alloy according to the present invention when processed to 6-inch thick plate is better than that disclosed in U.S.-2002/0150498-A1. In FIG. 2 also documented data for thick gauges of 75 to 220 mm are shown for the AA7050/7010 alloy (see AIMS 03-02-022, December 2001), the AA7050/7040 alloy (see AIMS 03-02-019, September 2001), and the AA7085 alloy (see AIMS 03-02-025, September 2002).

TABLE 5

| Ageing process | L-TYS (MPa) | L-UTS (MPa) | L-A50 (%) | L-T K1C (MPa · $m^{0.5}$) | EXCO |
|---|---|---|---|---|---|
| 5 hrs/120° C. + 11 hrs/165° C. | 453 | 497 | 9.9 | — | EA |
| 5 hrs/120° C. + 13 hrs/165° C. | 444 | 492 | 12.5 | 44.4 | EA |
| 5 hrs/120° C. + 15 hrs/165° C. | 434 | 485 | 13.0 | 45.0 | EA |
| 5 hrs/120° C. + 12 hrs/160° C. | 494 | 523 | 10.5 | 39.1 | EA |
| 5 hrs/120° C. + 14 hrs/160° C. | 479 | 213 | 8.3 | — | EA |

Example 4

Another full-scale ingot taken from the batch DC-cast from Example 2 was produced to plates of respectively 63.5 mm and 30 mm thickness. The cast ingot was scalped, homogenised at 12 hrs/470° C.+24 hrs/475° C.+air cooled to ambient temperature. The ingot was pre-heated at 8 hrs/410° C. and then hot rolled to respectively 63.5 and 30 mm. The obtained hot-rolled plates were solution heat treated (SHT) at 475° C. for about 2 to 4 hrs followed by water-spray quenching. The plates were stress relieved by a cold stretching operation of respectively 1.7% and 2.1% for the 63.5 mm and 30 mm plates. Several different two-step ageing processes have been applied.

The tensile results have been measured according to EN 10.002. The plane strain fracture toughness, Kq, has been measured according to ASTM E399-90 on CT-specimens. If the validity requirements as given in ASTM E399-90 are met, these Kq values are a real material property and called $K_{1C}$. The $K_{1C}$ has been measured at ambient room temperature ("RT"). The EXCO exfoliation corrosion resistance has been measured according to ASTM G34-97. The results are listed in Table 6. All ageing variants as shown in Table 6 showed "EA"-rating.

TABLE 6

| | | L-direction | | | | LT-direction | | | |
|---|---|---|---|---|---|---|---|---|---|
| Thickness (mm) | Ageing (° C.-hrs) | TYS MPa | UTS MPa | A50 (%) | L-T K1C MPa · vm | TYS (MPa) | UTS (MPa) | A50 (%) | T-L K1C MPa · $m^{0.5}$ |
| 63.5 | 120-5/ 150-12 | 566 | 594 | 10.7 | 42.4 | 532 | 572 | 9.8 | 32.8 |
| 63.5 | 120-5/ 155-12 | 566 | 599 | 11.9 | 40.7 | 521 | 561 | 11.2 | 33.0 |
| 63.5 | 120-5/ 160-12 | 528 | 569 | 13.0 | 51.6 | 497 | 516 | 11.6 | 40.2 |
| 30 | 120-5/ 150-12 | 565 | 590 | 14.2 | 46.9 | 558 | 582 | 13.9 | 36.3 |
| 30 | 120-5/ 155-12 | 557 | 589 | 14.4 | 51.0 | 547 | 572 | 13.6 | 39.2 |
| 30 | 120-5/ 160-12 | 501 | 548 | 15.1 | 65.0 | 493 | 539 | 14.3 | 46.8 |

In Table 7 the values are given of nowadays state of the art commercial upper wing alloys, and are typical data according to the supplier of that material (Alloy 7150-T7751 plate & 7150-T77511 extrusions, Alcoa Mill products, Inc., ACRP-069-B).

TABLE 7

| Typical values from ALCOA tech sheet on AA7150-T77 and AA7055-T77, both plates of 25 mm. | | | | | | | | | |
|---|---|---|---|---|---|---|---|---|---|
| | | L-direction | | | | LT-direction | | | |
| Thickness (mm) | Ageing (° C.-hrs) | TYS MPa | UTS MPa | A50 (%) | L-T K1C MPa · vm | TYS (MPa) | UTS (MPa) | A50 (%) | T-L K1C MPa · $m^{0.5}$ |
| 25 | 7150-T77 | 572 | 607 | 12.0 | 29.7 | 565 | 607 | 11.0 | 26.4 |
| 25 | 7055-T77 | 614 | 634 | 11.0 | 28.6 | 614 | 641 | 10.0 | 26.4 |

Figure 3:
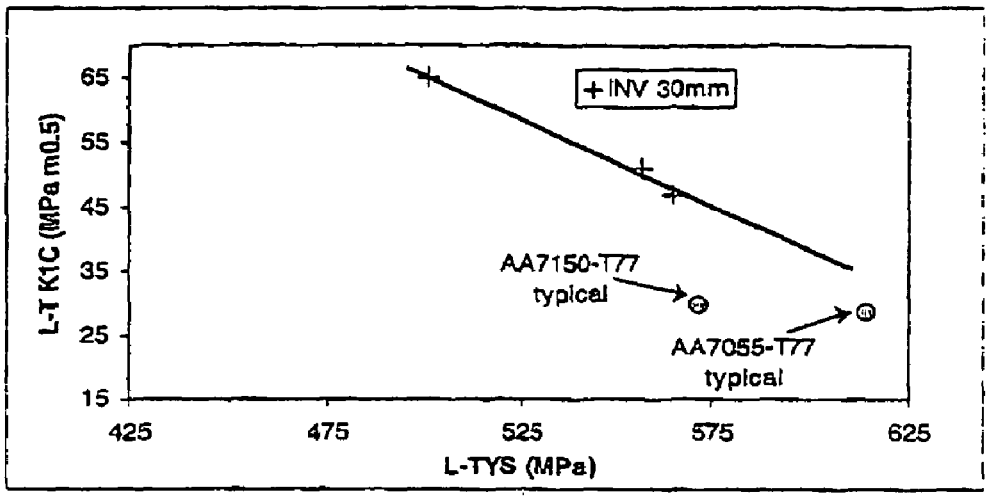
FIG. 3 is a diagram comparing the fracture toughness vs. the tensile yield strength for the alloy product according to this invention in a 30 mm gauge against two references.

In FIG. 3 a comparison is given of the inventive alloy versus AA7150-T77 and AA7055-T77. From FIG. 3 it can be clearly seen that the tensile versus toughness balance of the current inventive alloy is superior to commercial available AA7150-T77 and also to AA7055-T77.

Example 5

Another full-scale ingot taken from the batch DC-cast from Example 2 (hereinafter in Example 5 "Alloy A") was produced to plates of 20 mm thickness. Also one other casting was made (designated "Alloy B" for this example) with a chemical composition (in wt. %): 7.39% Zn, 1.66% Mg, 1.59% Cu, 0.08% Zr, 0.03% Si and 0.04% Fe, balance aluminium and unavoidable impurities. These ingots were scalped, homogenised at 12 hrs/470° C.+24 hrs/475° C.+air cooled to ambient temperature. For further processing, three different routes were used.

Route 1: The ingots of alloy A and B were pre-heated at 6 hrs/420° C. and then hot rolled to about 20 mm.

Route 2: Ingot of alloy A were pre-heated at 6 hrs/460° C. and then hot rolled to about 20 mm Route 3: Ingot of alloy B were pre-heated at 6 hrs/420° C. and then hot rolled to about 24 mm, subsequently these plates were cold rolled to 20 mm.

Thus, four variants were produced and identified as: A1, A2, B1 and B3. The resultant plates were solution heat treated at 475° C. for about 2 to 4 hrs followed by water-spray quenching. The plates were stress relieved by a cold stretching operation of about 2.1%. Several different two-step ageing processes have been applied, whereby for example "120-5/150-10" means 5 hrs at 120° C. followed by 10 hrs at 150° C.

The tensile results have been measured according to EN 10.002. The plane strain fracture toughness, Kq, has been measured according to ASTM E399-90 on CT specimens. If the validity requirements as given in ASTM E399-90 are met, these Kq values are a real material property and called $K_{1C}$ or KIC. Note that most of the fracture toughness measurement in this example failed the meet the validity criteria on specimen thickness. The reported Kq values are a conservative with respect to $K_{1C}$, in other words, the reported Kq values are in fact generally lower than the standard $K_{1C}$ values obtained when specimen size related validity criteria of ASTM E399-90 are satisfied. The exfoliation corrosion resistance has been measured according to ASTM G34-97. The results are listed in Table 8. All ageing variants as shown in Table 8 showed "EA"-rating for the EXCO resistance.

Figure 4:
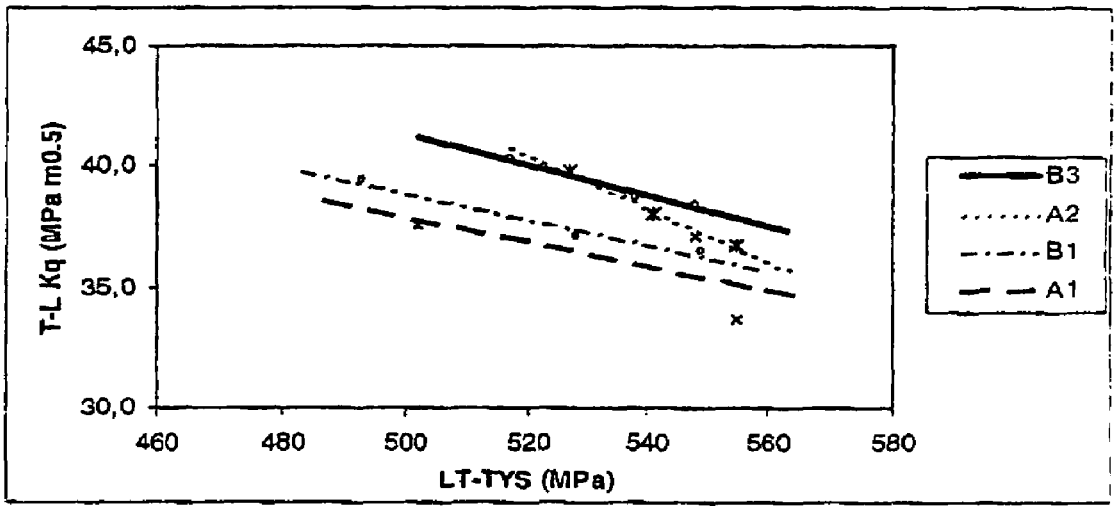
FIG. 4 is a diagram comparing the plane strain fracture toughness vs. the tensile yield strength for the alloy products according to the invention using different processing routes.

The results of Table 8 have are shown graphically in FIG. 4. In FIG. 4 lines have been fitted through the data to get an impression of the differences between A1, A2, B1 and B3. From that graph it can be clearly seen that alloy A and B, when comparing A1 and B1, have a similar strength versus toughness behaviour. The best strength versus toughness could be obtained by either B3 (i.e. cold rolling to final thickness) or by A2 (i.e. pre-heat at a higher temperature). Also note that the results of Table 8 show a significant better strength versus toughness balance than AA7150-T77 and AA7055-T77 as listed in Table 7.

TABLE 8

| | | L-direction | | | LT-direction | | | T-L KIC |
|---|---|---|---|---|---|---|---|---|
| Alloy | Ageing (° C.-hrs) | TYS MPa | UTS (MPa) | A50 (%) | TYS MPa | UTS MPa | A50 (%) | MPa · $m^{0.5}$ |
| B3 | 120-5/150-10 | 563 | 586 | 13.7 | 548 | 581 | 12.5 | 38.4 |
| B3 | 120-5/155-12 | 558 | 581 | 14.4 | 538 | 575 | 13.1 | 38.7 |
| B3 | 120-5/160-10 | 529 | 563 | 14.6 | 517 | 537 | 13.7 | 40.3 |
| B1 | 120-5/150-10 | 571 | 595 | 13.4 | 549 | 581 | 13.4 | 36.5 |
| B1 | 120-5/155-12 | 552 | 582 | 14.3 | 528 | 568 | 13.9 | 37.1 |
| B1 | 120-5/160-12 | 510 | 552 | 15.1 | 493 | 542 | 14.5 | 39.4 |
| A1 | 120-5/150-10 | 574 | 597 | 13.7 | 555 | 590 | 14.0 | 33.7 |
| A1 | 120-5/155-12 | 562 | 594 | 14.4 | 548 | 586 | 13.9 | 37.1 |
| A1 | 120-5/160-12 | 511 | 556 | 15.0 | 502 | 550 | 14.3 | 37.6 |
| A2 | 120-5/150-10 | 574 | 600 | 14.0 | 555 | 595 | 13.9 | 36.7 |
| A2 | 120-5/155-12 | 552 | 584 | 14.3 | 541 | 582 | 13.1 | 38.0 |
| A2 | 120-5/160-12 | 532 | 572 | 14.8 | 527 | 545 | 12.4 | 39.8 |

Example 6

On an industrial scale two alloys have been cast via DC-casting with a thickness of 440 mm and processed into sheet product of 4 mm. The alloy compositions are listed in Table 9, whereby alloy B represents an alloy composition according to a preferred embodiment of the invention when the alloy product is in the form of a sheet product.

The ingots were scalped, homogenized at 12 hrs/470° C.+24 hrs/475° C. and then hot rolled to an intermediate gauge of 65 mm and final hot rolled to about 9 mm. Finally the hot rolled intermediate products have been cold rolled to a gauge of 4 mm. The obtained sheet products were solution heat treated at 475° C. for about 20 minutes, followed by water-spray quenching. The resultant sheets were stress relieved by a cold stretching operation of about 2%. The stretched sheets have been aged thereafter for 5 hrs/120° C.+8 hrs/165° C. Mechanical properties have tested analogue to Example 1 and the results are listed in Table 10.

The results of this full-scale trial confirm the results of Example 1 that the positive addition of Mn in the defined range significantly improves the toughness (both UPE and Ts/Rp) of the sheet product resulting in a very good and desirable strength-toughness balance.

TABLE 9

| | Chemical composition of the alloys tested, balance impurities and aluminium | | | | | | | |
|---|---|---|---|---|---|---|---|---|
| Alloy | Si | Fe | Cu | Mn | Mg | Zn | Ti | Zr |
| A | 0.03 | 0.08 | 1.61 | — | 1.86 | 7.4 | 0.03 | 0.08 |
| B | 0.03 | 0.06 | 1.59 | 0.07 | 1.96 | 7.36 | 0.03 | 0.09 |

TABLE 10

Mechanical properties of the alloy products tested for two testing directions.

| | L-direction | | | | | | LT-direction | | | | | |
|---|---|---|---|---|---|---|---|---|---|---|---|---|
| Alloy | Rp MPa | Rm MPa | A50 (%) | TS | UPE | Ts/ Rp | Rp MPa | Rm | A50 (%) | TS | UPE | Ts/ Rp |
| A | 497 | 534 | 11.0 | 694 | 90 | 1.40 | 479 | 526 | 12.0 | 712 | 134 | 1.49 |
| B | 480 | 527 | 12.9 | 756 | 152 | 1.58 | 477 | 525 | 12.8 | 712 | 145 | 1.49 |

Example 7

On an industrial scale two alloys have been cast via DC-casting with a thickness of 440 mm and processed into a plate product having a thickness of 152 mm. The alloy compositions are listed in Table 11, whereby alloy C represents a typical alloy falling within the AA7050-series range and alloy D represents an alloy composition according to a preferred embodiment of the invention when the alloy product is in the form of plate, e.g. thick plate.

The ingots were scalped, homogenized in a two-step cycle of 12 hrs/470° C.+24 hrs/475° C. and air cooled to ambient temperature. The ingot was pre-heated at 8 hrs/410° C. and then hot rolled to final gauge. The obtained plate products were solution heat treated at 475° C. for about 6 hours, followed by water-spray quenching. The resultant plates were stretched by a cold stretching operation for about 2%. The stretched plates have been aged using a two-step ageing practice of first 5 hrs/120° C. followed by 12 hrs/165° C. Mechanical properties have been tested analogue to Example 3 in three test directions and the results are listed in Table 12 and 13. The specimens were taken from S/4 position from the plate for the L- and LT-testing direction and at S/2 for the ST-testing direction The Kapp has been measured at S/2 and S/4 locations in the L-T direction using panels having a width of 160 mm centre cracked panels and having a thickness of 6.3 mm after milling. These Kapp measurements have been carried out at room temperature in accordance with ASTM E561. The designation "ok" for the SCC means that no failure occurred at 180 MPa/45 days.

From the results of Tables 12 and 13 it can be seen that the alloy according to the invention in comparison with AA7050 has similar corrosion performance, the strength (yield strength and tensile strength) are comparable or slightly better than AA7050, in particular in the ST-direction. But more importantly the alloy of the present invention shown significantly better results in elongation (or A50) in the ST-direction. The elongation (or A50), in particular the elongation in ST-direction, is an important engineering parameter of amongst others ribs for use in an aircraft wing structure. The alloy product according to the invention further shows a significant improvement in fracture toughness (both Kic and Kapp).

TABLE 11

Chemical composition of the alloys tested, balance impurities and aluminium.

| Alloy | Si | Fe | Cu | Mn | Mg | Zn | Ti | Zr |
|---|---|---|---|---|---|---|---|---|
| C | 0.02 | 0.04 | 2.14 | — | 2.04 | 6.12 | 0.02 | 0.09 |
| D | 0.03 | 0.05 | 1.58 | 0.07 | 1.96 | 7.35 | 0.03 | 0.09 |

TABLE 12

Tensile test results of the plate products for three testing directions.

| Alloy | TYS (MPa) | TYS (MPa) | TYS (MPa) | UTS (MPa) | UTS (MPa) | UTS (MPa) | Elong (%) | Elong (%) | Elong. (%) |
|---|---|---|---|---|---|---|---|---|---|
| | L | LT | ST | L | LT | ST | L | LT | ST |
| C | 483 | 472 | 440 | 528 | 537 | 513 | 9.0 | 7.3 | 3.3 |
| D | 496 | 486 | 460 | 531 | 542 | 526 | 9.2 | 8.0 | 5.8 |

TABLE 13

Further properties of the plate products tested.

| Alloy | L-T KIC ($MPa \cdot m^{0.5}$) | T-L KIC ($MPa \cdot m^{0.5}$) | S-L KIC ($MPa \cdot m^{0.5}$) | L-T Kapp ($MPa \cdot m^{0.5}$) | | EXCO | SCC |
|---|---|---|---|---|---|---|---|
| C | 27.8 | 26.3 | 26.2 | 45.8(s/4) | 52(s/2) | EA | ok |
| D | 30.3 | 29.4 | 29.1 | 62.6(s/4) | 78.1(s/2) | EA | ok |

Example 8

On an industrial scale two alloys have been cast via DC-casting with a thickness of 440 mm and processed into a plate product having a thickness of 63.5 mm. The alloy compositions are listed in Table 14, whereby alloy F represents an alloy composition according to a preferred embodiment of the invention when the alloy product is in the form of plate for wings.

The ingots were scalped, homogenized in a two-step cycle of 12 hrs/470° C.+24 hrs/475° C. and air cooled to ambient temperature. The ingot was pre-heated at 8 hrs/410° C. and then hot rolled to final gauge. The obtained plate products were solution heat treated at 475° C. for about 4 hours, followed by water-spray quenching. The resultant plates were stretched by a cold stretching operation for about 2%. The stretched plates have been aged using a two-step ageing practice of first 5 hrs/120° C. followed by 10 hrs/155° C.

Mechanical properties have been tested analogue to Example 3 in three test directions are listed in Table 15. The specimens were taken from T/2 position. Both alloys had a EXCO test result of "EB".

From the results of Table 15 it can be seen that the positive addition of Mn results in an increase of the tensile properties. But most importantly the properties, and in particular the elongation (or A50), in the ST-direction are significantly improved. The elongation (or A50) in the ST-direction is an important engineering parameter for structural parts of an aircraft, e.g. wing plate material.

TABLE 14

Chemical composition of the alloys tested, balance impurities and aluminium.

| Alloy | Si | Fe | Cu | Mn | Mg | Zn | Ti | Zr |
|---|---|---|---|---|---|---|---|---|
| E | 0.02 | 0.04 | 1.49 | — | 1.81 | 7.4 | 0.03 | 0.08 |
| F | 0.03 | 0.05 | 1.58 | 0.07 | 1.95 | 7.4 | 0.03 | 0.09 |

TABLE 15

Mechanical properties of the products tested for three testing directions.

| | L-direction | | | LT-direction | | | ST-direction | | |
|---|---|---|---|---|---|---|---|---|---|
| Alloy | TYS (MPa) | UTS (MPa) | Elong. (%) | TYS (MPa) | UTS (MPa) | Elong. (%) | TYS (MPa) | UTS (MPa) | Elong. (%) |
| E | 566 | 599 | 12 | 521 | 561 | 11 | 493 | 565 | 5.3 |
| F | 569 | 602 | 13 | 536 | 573 | 9.5 | 520 | 586 | 8.1 |

Having now fully described the invention, it will be apparent to one of ordinary skill in the art that many changes and modifications can be made without departing from the spirit or scope of the invention as hereon described.

The invention claimed is:

1. An aluminium alloy product with high strength and fracture toughness and a good corrosion resistance, said alloy consisting of, in weight %:

| | |
|---|---|
| Zn | 7.2 to 7.43 |
| Mg | 1.92 to 2.1 |
| Cu | 1.43 to 1.80 |

-continued

| | |
|---|---|
| Zr | about 0.06 to 0.1 |
| Fe | <about 0.08 |
| Si | <about 0.07 |
| Mn | 0.05 to 0.11 |

and other impurities or incidental elements each <0.05, total <0.15, and the balance being aluminium.

2. Aluminium alloy product according to claim 1, wherein

| | |
|---|---|
| Mg | 1.92 to 1.95. |

3. Aluminium alloy product according to claim 1, wherein

| | |
|---|---|
| Mg | 1.92 to 1.95 |
| Cu | 1.43 to 1.75. |

4. An aluminium aluminium alloy product according to claim 1,said alloy consisting of, in weight %:

| | |
|---|---|
| Zn | 7.2 to 7.43 |
| Mg | 1.92 to 2.1 |
| Cu | 1.43 to 1.75 |
| Zr | about 0.06 to 0.10 |
| Fe | <0.08 |
| Si | <0.07 |
| Mn | 0.05 to 0.11 |
| Ti | <0.05, |

and other impurities or incidental elements each <0.05, total <0.15, and the balance being aluminium.

5. Aluminium alloy product according to claim 1, wherein the product has an EXCO corrosion resistance of "EB" or better.

6. Aluminium alloy product according to claim 1, wherein the product has an EXCO corrosion resistance of "EA" or better.

7. Aluminium alloy product according to claim 1, wherein the product is in the form of a sheet, plate, forging or extrusion.

8. Aluminium alloy product according to claim 1, wherein the product is in the form of a sheet, plate, forging or extrusion as part of an aircraft structural part.

9. Aluminium alloy product according to claim 1, wherein the product is fuselage sheet, upper wing plate, lower wing plate, thick plate for machined parts, forging or thin sheet for stringers.

10. Aluminium alloy product according to claim 1, wherein the product has a thickness in the range of 0.7 to 3 inch at its thickest cross sectional point.

11. Aluminium alloy product according to claim 1, wherein the product has a thickness of less than 1 .5 inch.

12. Aluminium alloy product according to claim 11, wherein the product has a thickness of less than 1.0 inch.

13. Aluminium alloy product according to claim 1, wherein the product has a thickness of more than 2.5 inch.

14. Aluminium alloy product according to claim 13, wherein the product has a thickness in the range of 2.5 to 11 inch.

15. Aluminium alloy product according to claim 1, which in an extrusion having a thickness in the range of at most 10 mm at its thickest cross sectional point.

16. Aluminium alloy product according to claim 1, which is an extrusion having a thickness in the range of 2 to 6 inch at its thickest cross sectional point.

17. Aluminium alloy product according to claim 1, wherein the Mn-content is in the range of 0.09 to 0.11.

18. Aluminium alloy product according to claim 1, wherein the product is in the form of a sheet or plate.

19. Aluminium alloy product according to claim 1, wherein the product is in the form of a forging or extrusion.

20. Aluminium alloy product according to claim 19, wherein the product has a thickness of less than 1.0 inch.

21. Aluminium alloy product according to claim 19, wherein the product has a thickness of more than 2.5 inch.

22. Aluminium alloy product according to claim 21, wherein the product has a thickness in the range of 2.5 to 11 inch.

23. Aluminium alloy product according to claim 19, wherein the product is in the form of a forging or extrusion as part of an aircraft structural part.

24. Aluminium alloy product according to claim 3, wherein the product is fuselage sheet, upper wing plate, lower wing plate, thick plate for machined parts, forging or thin sheet for stringers.

25. Aluminium alloy product according to claim 3, which in an extrusion having a thickness in the range of at most 10 mm at its thickest cross sectional point.

26. Aluminium alloy product according to claim 3, which is an extrusion having a thickness in the range of 2 to 6 inch at its thickest cross sectional point.

27. Aluminium alloy product according to claim 3, wherein the product has an EXCO corrosion resistance of "EB" or better.

28. Aluminium alloy product according to claim 3, wherein the product has an EXCO corrosion resistance of "EA" or better.

29. Aluminium alloy product according to claim 1, which is a plate product having a thickness of 2.5 inch or more and exhibiting increased elongation in the ST-testing direction compared to its AA7050 counterpart.

30. Aluminium alloy product according to claim 29, which plate product has an elongation in the ST-testing direction of 5% or more.

31. Aluminium alloy product according to claim 29, which plate product has an elongation in the ST-testing direction of 5.5% or more.

32. Aluminium alloy product according to claim 1, which is a plate product having a thickness of 2.5 inch or more and exhibiting a fracture toughness Kapp improvement of at least 20% compared to its AA7050 aluminium alloy counterpart in the L-T testing direction at ambient room temperature and when measured at S/4 according to ASTM E561 using 16-inch centre cracked panels.

33. Aluminium alloy product according to claim 1, which is a plate product having a thickness of 2.5 inch or more and exhibiting a fracture toughness Kapp improvement of at least 20% compared to its AA7050 aluminium alloy counterpart in the L-T testing direction at ambient room temperature and when measured at S/4 according to ASTM E561 using 16-inch centre cracked panels.

34. An aluminium alloy structural component for a commercial jet aircraft, said structural component made from an aluminium alloy product according to claim 1.

35. An aluminium alloy structural component for a commercial jet aircraft, said structural component made from an aluminium alloy product according to claim 3.

36. Method of producing a high-strength, high-toughness AA7xxx-series alloy product having a good corrosion resistance, comprising the processing steps of:

a.) casting an ingot having a composition according to claim 1;

b.) homogenising and/or pre-heating the ingot after casting;

c.) hot working the ingot into a pre-worked product by one or more methods selected from the group consisting of: rolling, extruding and forging;

d.) optionally reheating the pre-worked product and either, e.) hot working and/or cold working to a desired workpiece form;

f.) solution heat treating said formed workpiece at a temperature and time sufficient to place into solid solution essentially all soluble constituents in the alloy;

g.) quenching the solution heat treated workpiece by one of spray quenching or immersion quenching in water or other quenching media;

h.) optionally stretching or compressing of the quenched workpiece;

i.) artificially ageing the quenched and optionally stretched or compressed workpiece to achieve a desired temper.

37. Method according to claim 36, wherein during processing step i.) the alloy product is artificially aged to a temper selected from the group consisting of T6, T74, T76, T751, T7451, T7651, T77 and T79.

38. Method according to claim 36, wherein during processing step h.) the alloy product has been stretched in a range at most 8%.

39. Method according to claim 36, wherein during processing step b.) the ingot has been homogenised at a temperature in the range of 460 to 490° C.

40. Method according to claim 36, wherein the alloy product has been processed to fuselage sheet.

41. Method according to claim 40, wherein the alloy product has been processed to fuselage sheet having a thickness of less than 1 .5 inch.

42. Method according to claim 36, wherein the alloy product has been processed to lower wing plate.

43. Method according to claim 36, wherein the alloy product has been processed to upper wing plate.

44. Method according to claim 36, wherein the alloy product has been processed to an extruded product.

45. Method according to claim 36, wherein the alloy product has been processed to a forged product.

46. Method according to claim 36, wherein the alloy product has been processed to a thin plate having a thickness in the range of 0.7 to 3 inch.

47. Method according to claim 36, wherein the alloy product has been processed to a thick plate having a thickness at most 11 inch.

48. Method of producing a high-strength, high-toughness AA7xxx-series alloy product having a good corrosion resistance, comprising the processing steps of:

a.) casting an ingot having a composition according to claim 33, b.) homogenising and/or pre-heating the ingot after casting;

c.) hot working the ingot into a pre-worked product by one or more methods selected from the group consisting of: rolling, extruding and forging;

d.) optionally reheating the pre-worked product and either, e.) hot working and/or cold working to a desired workpiece form;

f.) solution heat treating said formed workpiece at a temperature and time sufficient to place into solid solution essentially all soluble constituents in the alloy;

g.) quenching the solution heat treated workpiece by one of spray quenching or immersion quenching in water or other quenching media;

h.) optionally stretching or compressing of the quenched workpiece;

i.) artificially ageing the quenched and optionally stretched or compressed workpiece to achieve a desired temper.

49. Method according to claim 48, wherein during processing step i.) the alloy product is artificially aged to a temper selected from the group consisting of T6, T74, T76, T751, T7451, T7651, T77 and T79.

50. Method according to claim 48, wherein during processing step h.) the alloy product has been stretched in a range to at most 8%.

51. Method according to claim 48, wherein during processing step b.) the ingot has been homogenised at a temperature in the range of 460 to 490° C.

52. Method according to claim 48, wherein the alloy product has been processed to fuselage sheet.

53. Method according to claim 48, wherein the alloy product has been processed to fuselage sheet having a thickness of less than 1.5 inch.

54. Method according to claim 48, wherein the alloy product has been processed to lower wing plate.

55. Method according to claim 48, wherein the alloy product has been processed to upper wing plate.

56. Method according to claim 48, wherein the alloy product has been processed to an extruded product.

57. Method according to claim 48, wherein the alloy product has been processed to a forged product.

58. Method according to claim 48, wherein the alloy product has been processed to a thin plate having a thickness in the range of 0.7 to 3 inch.

59. Method according to claim 48, wherein the alloy product has been processed to a thick plate having a thickness of at most 11 inches.

* * * * *

UNITED STATES PATENT AND TRADEMARK OFFICE

CERTIFICATE OF CORRECTION

PATENT NO. : 7,666,267 B2
APPLICATION NO. : 10/821184
DATED : February 23, 2010
INVENTOR(S) : Benedictus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 845 days.

Signed and Sealed this

Twenty-eighth Day of December, 2010

David J. Kappos

David J. Kappos
*Director of the United States Patent and Trademark Office*